US005850865A

United States Patent [19]

Hsieh

[11] Patent Number: 5,850,865

[45] Date of Patent: Dec. 22, 1998

[54] ROLLING FIRE DOOR WITH DELAYED CLOSING MECHANISM

[76] Inventor: Chung-Jung Hsieh, 1st Fl., No. 15, Sub-lane 3, Lane 217, Chung-Hsiao E. Rd., Sec. 3, Taipei, Taiwan

[21] Appl. No.: 931,176

[22] Filed: Sep. 16, 1997

[51] Int. Cl.[6] ..... A47G 5/02

[52] U.S. Cl. ..... 160/310; 160/9

[58] Field of Search ..... 160/1, 7, 8, 9, 160/310, 188, 189, 311

[56] References Cited

U.S. PATENT DOCUMENTS

| | | | |
|---|---|---|---|
| 3,807,480 | 4/1974 | Smart | 160/1 |
| 4,130,156 | 12/1978 | Wardlaw | 160/9 |
| 5,203,392 | 4/1993 | Shea | 160/7 |
| 5,245,879 | 9/1993 | McKeon | 160/7 X |
| 5,253,693 | 10/1993 | Marlatt et al. | 160/7 |
| 5,261,186 | 11/1993 | Saino | 160/1 X |
| 5,542,460 | 8/1996 | McKeon | 160/1 X |
| 5,576,581 | 11/1996 | Iannuzzi et al. | 160/310 X |

*Primary Examiner*—David M. Purol

*Attorney, Agent, or Firm*—Bucknam and Archer

[57] ABSTRACT

A delayed closing mechanism for a rolling fire door is provided wherein an AC solenoid having its sliding rod pivoted to one end of a connecting rod which is also pivoted at a central portion while the other end of the connecting rod is pivoted to the lower end of a spring biased actuation rod, a recess is provided on a side of the actuation rod to form a shoulder, the upper end of a latch rod pivoted at its central portion swings into the recess of the actuation rod and its lower end is acted on through a DC solenoid which can be controlled by an operator or activated through the discharge from a capacitor in the event power is cut off, the DC solenoid sliding rod is activated to swing the latch rod to move away from its position blocking the actuation rod, and cutting off power to the AC solenoid. The spring biased actuation rod pushes the braking rod in the braking device to pivot and thereby release the brake so as to permit the door to open or close. In the event of fire and the door is open where power is not yet cut off, the control system excites the DC solenoid in the circuit to extend the sliding rod and pivot the latch rod to move away from the position blocking the actuation rod which is pushed out to release rotor braking, and the door is closed by its own weight.

7 Claims, 5 Drawing Sheets

ROLLING FIRE DOOR WITH DELAYED CLOSING MECHANISM

BACKGROUND OF THE INVENTION

The present invention relates to a rolling fire door, more particularly, to a rolling fire door having an automatically delayed closing mechanism which automatically releases a braking device after a preset time to allow the door to be closed by its own weight and which is applicable to a fire prevention system installed in a warehouse with multiple accesses. In the event of a fire, all doors will be closed one by one in preset sequence not only to prevent the fire and smoke from spreading outside the warehouse but also to allow any individuals inside the warehouse to escape within sufficient time.

BACKGROUND OF THE PRIOR ART

The conventional rolling fire door installed in a warehouse is used to close up the warehouse under normal circumstances. However, under emergency circumstances, such as fire, etc., it may prevent the flames and smoke from spreading beyond the warehouse. If a fire breaks out in a warehouse provided with a fire alarm system, a fire is detected by one or more detectors of the fire alarm system which transmits a signal to a fire fighting system to execute a series of preset extinguishing steps, such as closing the rolling fire doors, turning off a power source, etc. If there is no one on duty inside the warehouse at night, the conventional rolling fire door is in the closed condition and there is no problem. However, during the day time when there are people inside the warehouse, the rolling fire door may be closed before the people have an opportunity to escape, or else the power supply having been cut off or burnt out prevents closing of the rolling fire door and under such circumstances conventional rolling fire doors therefore are not effective for preventing the spread of fire and also lifesaving.

SUMMARY OF THE INVENTION

The primary purpose of the present invention is to provide a rolling fire door with delayed closing mechanism which permits sufficient time for people to escape from a fire, and at the same time automatically releases the braking device provided within the mechanism so that the door is closed by its own weight with or without the normal power source to thereby stop the spread of the fire. Accordingly, the design of the present invention is not only effective to prevent the spreading of a fire, but it is also effective for lifesaving.

Another purpose of the present invention is to provide an automatically delayed closing mechanism to each of a plurality of rolling fire doors in the same warehouse so that in case of a fire, all doors are automatically closed according to preset time intervals and sequence so as to permit sufficient time for workers inside the warehouse to escape.

A further purpose of the present invention is to provide a delayed closing mechanism for a rolling fire door which may automatically close when power is cut off and releasing of the roller brake is halted once power is restored within the preset delayed time, so that the rolling fire door connected to an external back-up power source will not be closed before the back-up power source is activated.

The present invention comprises an AC solenoid having its sliding rod pivoted to one end of a connecting rod which is also pivoted at a central portion while the other end of the connecting rod is pivoted to the lower end of a spring biased actuation rod. A recess is provided on a side of the actuation rod to form a shoulder. The upper end of a latch rod pivoted at its central portion swings into the recess of the actuation rod and its lower end is acted through a DC solenoid which can be controlled by an operator or activated through the discharge from a capacitor in the event power is cut off.

In a normal use situation, when the door opening or door closing button is pressed to activate the motor for positive or inverse revolution, the DC solenoid sliding rod is activated to swing the latch rod to move away from its position blocking the actuation rod, and cutting off power to the AC solenoid. Then the actuation rod, being biased by said spring, pushes the braking rod in the braking device to pivot and thereby release the brake so as to permit the door to open or close as the case may be. In the event a fire breaks out and the door is in an open state and about to close where power is not yet cut off, the conventional intermediate control system may be used to excite the DC solenoid in the circuit so as to extend the sliding rod and pivot the latch rod to move away from the position of blocking the actuation rod, which is pushed out by the spring acting on it continuously to release rotor braking, and the door is closed by its own weight by unwinding from the rotor. If the power supply is cut off, a capacitor discharges to a delayed relay for a preset time, then another capacitor is provided to discharge to the DC solenoid to pivot the latch rod to move away from the position of blocking the actuation rod, which in turn pushes the brake rod to release the brake and the door is closed by its own weight as unwinding from the rotor. Therefore, the present invention provides two major functions no matter whether the power source is cut off or not: it may prevent the fire and smoke from spreading outside the warehouse by automatically closing the door, and it may also permit people inside the warehouse to escape in time by delayed closing during fire.

DETAILED DESCRIPTION OF THE PREFERRED EMBODIMENT

Figure 1:
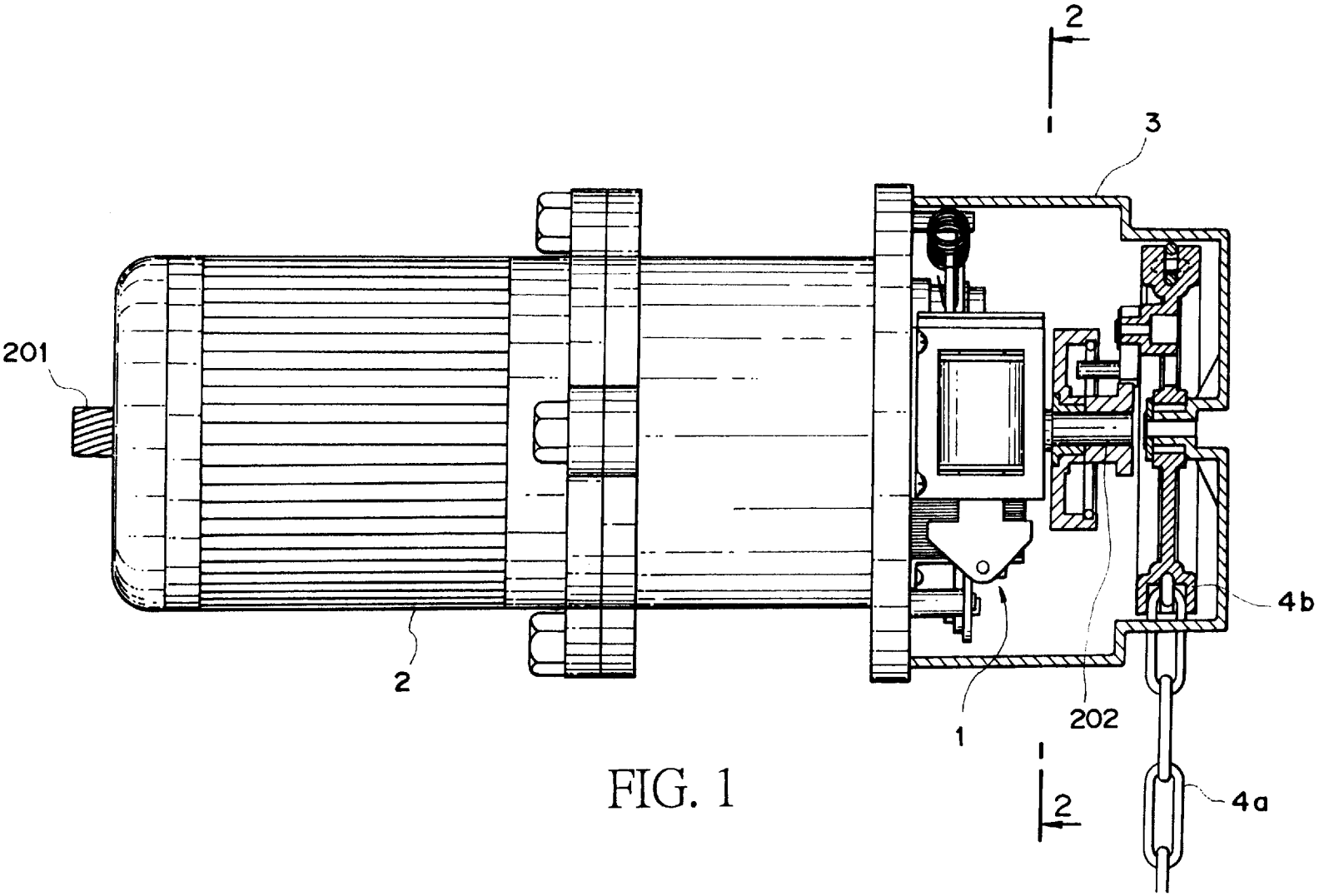
FIG. 1 is a side elevational view partly in cross-section of the motor and mechanism of the present invention.

As illustrated in FIG. 1, a casing 3 provided on the right end of motor 2 houses the delayed closing mechanism 1 of the present invention. The left end of shaft 201 of motor 2 protruding from the casing of motor 2 operates to drive a rotor (not illustrated) for rolling the door up or down. The right end 202 of shaft 201 of motor 2 extends beyond delayed closing mechanism 1 and operates in conjunction with the pulling chains 4*a* and chain wheel 4*b*, so as to open the door manually in the absence of power.

Figure 2:
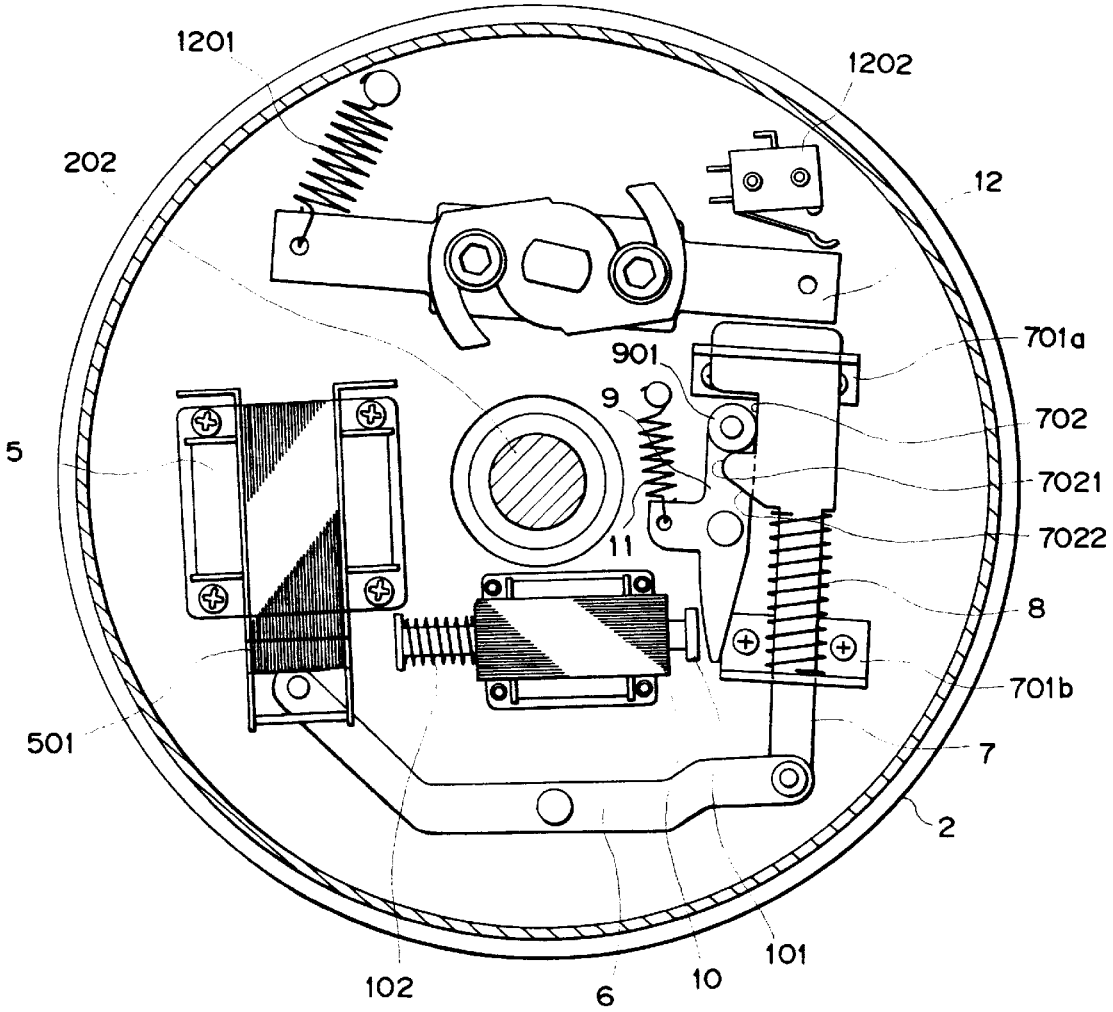
FIG. 2 is a cross-sectional view taken along the line 2—2 of FIG. 1 showing the relative position among the components of the present invention in the braking status.

In FIG. 2 an AC solenoid 5 is shown arranged to the left side of motor shaft end 202. The lower or operating end of a slide rod 501 of solenoid 5 is pivoted to one end of a connecting rod 6. The center portion of connecting rod 6 is pivoted to the right end of the motor casing, and the other end is pivoted to one end of a brake actuation rod 7. The direction of movement of actuation rod 7 is controlled by guide blocks 701*a* and 701*b* arranged at the upper part and lower part, respectively, of actuation rod 7, and actuation rod 7 always tends to move linearly upwardly due to the biasing action of spring 8. A right angle recess 702 is formed at the left side of actuation rod 7 and an oblique 7022 is formed on the lower end of a protrusion 7021 extending below recess 702. A latch rod 9 is pivoted at the left side of actuation rod 7 and roller 901 is pivotally mounted to the top end of latch rod 9. Roller 901 is biased to the right by means of off-center spring 11 acting on latch rod 9. Roller 901 is controlled to swing to its left by the function of DC solenoid 10 provided below it.

Figure 3:
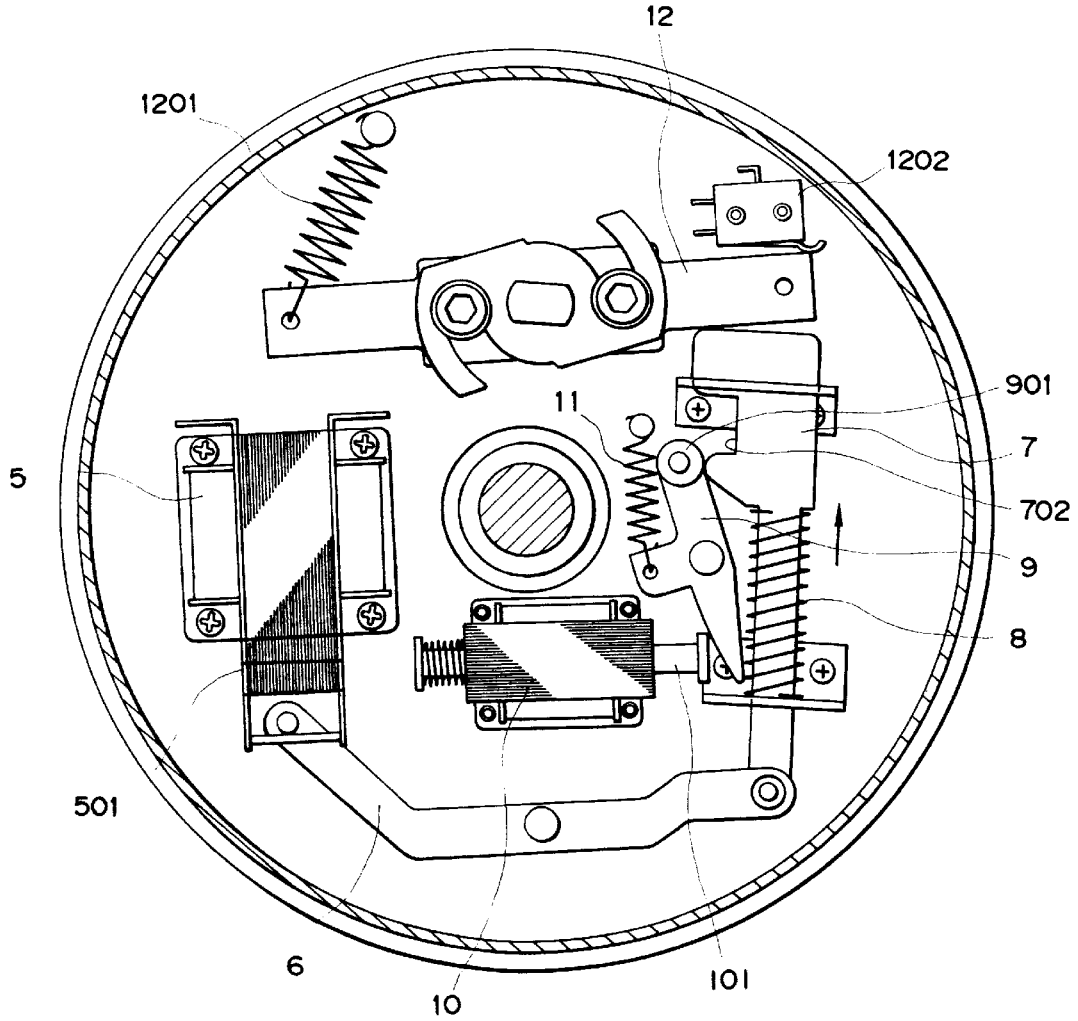
FIG. 3 is a cross-sectional view showing the status of the present invention when said brake as illustrated in FIG. 2 is released.
Figure 5:
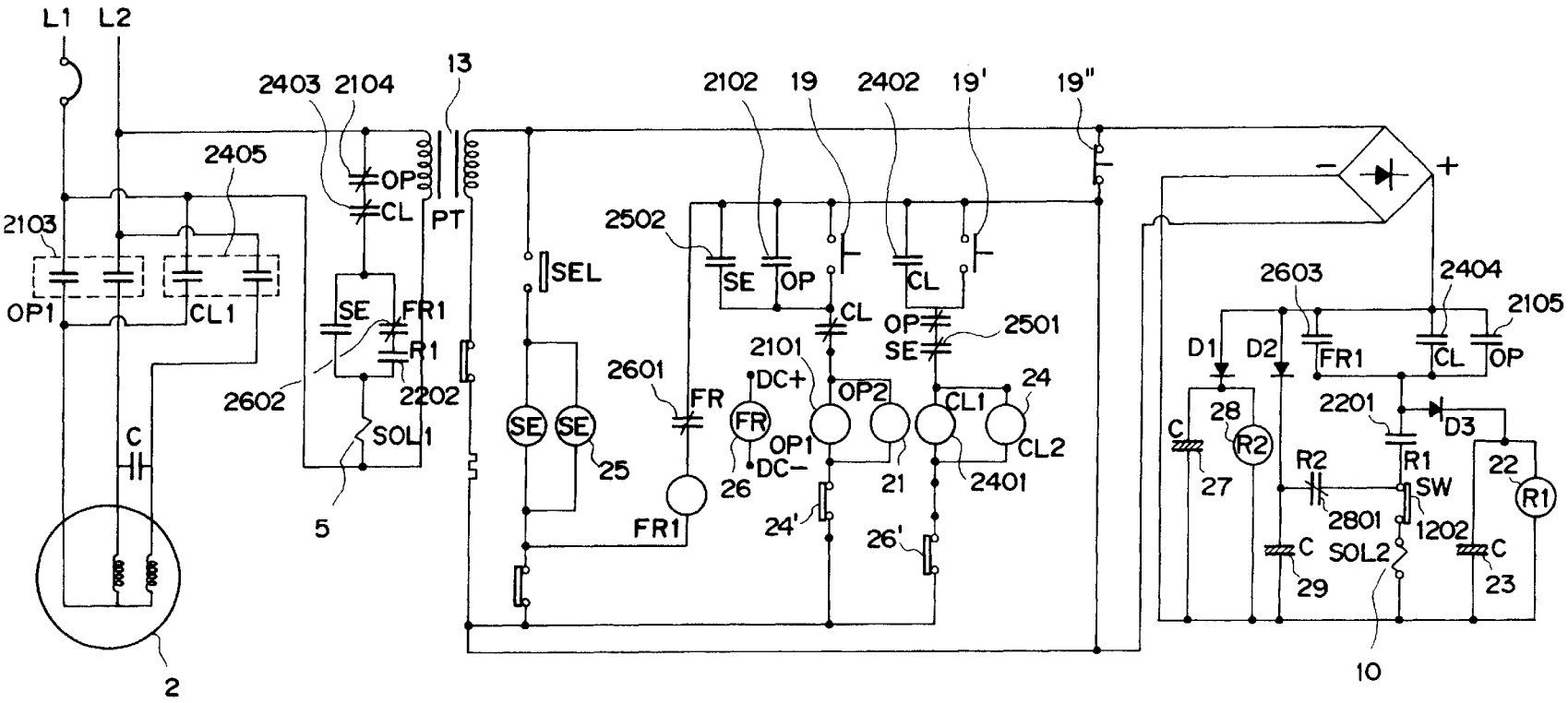
FIG. 5 is the diagram of the control circuit used in the present invention.

FIG. 5 shows the wiring diagram of motor 2, AC solenoid 5 and DC solenoid 10. When normal power is supplied, the rolling fire door is opened when the button 19 is pressed. Relay 21 for door opening is excited as the AC current from a transformer 13 flows into relay 21 and maintains it in excited status with both normally open contacts 2101 and 2102 closed while another normally open contact 2103 is also closed to allow the current to flow into motor 2. A normally closed contact 2014 on the branch circuit to AC solenoid 5 opens to make said AC solenoid 5 form a closed loop and is disabled while the normally open contact 2105 of the rectifying circuit is closed for the diverted DC to recharge both the retaining relay 22 and the capacitor 23. When normally open contact 2201 to relay 22 is closed to induce DC to flow into DC solenoid 10, relay 22 is excited and the sliding rod 102 is forced to move to its right and overcome spring 11 acting on latch rod 9 which then swings counter-clockwise. Roller 901 of latch rod 9 is thus released from its position of blocking actuation rod 7 which in turn moves upwardly by the action of compressed spring 8. The upward movement of actuation rod 7 pushes against brake rod 12 in the braking device provided in front of actuation rod 7 to overcome the clockwise bias provided by the pulling force of spring 1201, thereby releasing the brake of said braking device. When actuation rod 7 reaches its final position, brake rod 12 pushes against and triggers normally closed microswitch 1202 to open status and thus cut off power supply to DC solenoid 10. All members to said delayed closing mechanism are under the status as illustrated in FIG. 3.

At the same time when the braking device releases the brake in the manner stated as above, the rotor is rotated by motor 2 to roll up and open the door. When the door is rolled up to its full open height, it contacts a microswitch 24' (refer to FIG. 5) to cut off door opening relay 21, simultaneously contact 2104 is restored to its normally closed status and contact 2105 to its normally open status. Though no current flows into relay 22, it continues to maintain excited status by the discharge from capacitor 23 to close contact 2002 on the branch to AC solenoid 5. Therefore, AC solenoid 5 is excited when AC starts to flow into it, and the sliding rod 501 on AC solenoid 5 moves upward from its position as illustrated in FIG. 3 to pull actuation rod 7 downward through connecting rod 6 overcoming spring 8. When actuation rod 7 is pulled down to reach its final position, roller 901 on latch rod 9 acted by spring 11 falls once again into recess 702 to block actuation rod 7. When actuation rod 7 is moved downwardly, brake rod 12 is forced to return to its original position by the action of spring 1201 and thus cause the braking device to resume its braking status and microswitch 1202 is restored to its normally closed status as brake rod 12 leaves it. Finally, the released status as illustrated in FIG. 3 of the entire delayed closing mechanism is restored to that as illustrated in FIG. 2 and maintains the door in the open position without power being supplied.

To close the door, the button 19' is pressed and the current flows into door closing relay 24, which is excited. Once button 19' is released, said relay 24 maintains its excited status through contact 2401. Simultaneously the current which makes motor 2 reverse flows through closed contact 2405 into said motor 2, and there is no current supplied to solenoid 5 as normally closed contact 2403 on the branch to AC solenoid 5 opens.

The closure of contact 2404 allows DC to flow into relay 22 and capacitor 23 in parallel, and DC solenoid 10. DC solenoid 10 then acts on latch rod 9 to release the brake and motor 2 causes the rotor to unwind to close the door until it contacts microswitch 26' provided on the floor. Normally closed microswitch 26' is thus opened and cuts off the current to door closing relay 24, then each contact to rely 24 is restored to its normal status, thus stopping motor 2 and DC solenoid 10. Discharge from capacitor 23 causes the AC solenoid 5 circuit to be conducted to pull down actuation rod 7 which is then blocked by latch rod 9 when excited by AC, and thus maintain the delayed closing mechanism in braking status.

Three diodes D1, D2 and D3 are provided beside the rectifier as illustrated in FIG. 5 to prevent the inverse flow of current.

In the event of fire and the rolling fire door is in its open status with the power having not yet been cut off or burnt out, the signal that a fire is detected is transmitted to an intermediate control station where commands are given to fire relay 26 to open up normally closed contacts 2601 and 2602 without any current flowing in. Normally open contact 2603 beside the rectifier is closed to permit current to flow into relay 22. Thus, relay 22 remains activated to close normally open contact 2201 and the DC solenoid 10 is excited to release the brake of the braking device. Finally, the door by its own weight is unwound from the rotor and closes. If the power is cut off, capacitor 27 already recharged before the power failure, begins discharging to another door closing delayed relay 28 to keep its normally open contact 2801 in the open status. Upon completion of the discharge of capacitor 27 after a preset time, contact 2801 of the door closing delayed relay 28 is restored to its normal status and closes, and capacitor 29 commences to discharge to DC solenoid 10 causing latch rod 9 to turn away from its position blocking actuation rod 7. Actuation rod 7 acted on by the pre-compressed spring 8 pushes brake rod 12 to release the brake of the braking device, further causing the door to unwind and close by its own weight.

If any object passes the door and contacts the microswitch SEL in the course of descending of the door, the safety relay SE will stop the door from further descending as relay 25 is excited to open normally closed contact 2501 and to close normally open contact 2502 to rise the door. In the preferred embodiment of the present invention, the length of the discharge time of capacitor 27 can be altered by readjusting the capacity thereof as well as the value of resistance, thus allowing sufficient time for people inside the warehouse to escape. Also, in the event of a warehouse provided with multiple doors, the discharge time of capacitors 27 installed in each door with a delayed closing mechanism of the present invention can be altered, so as to make the closing time for each door in a warehouse different, allowing sufficient time for people inside the warehouse to escape.

Figure 4:
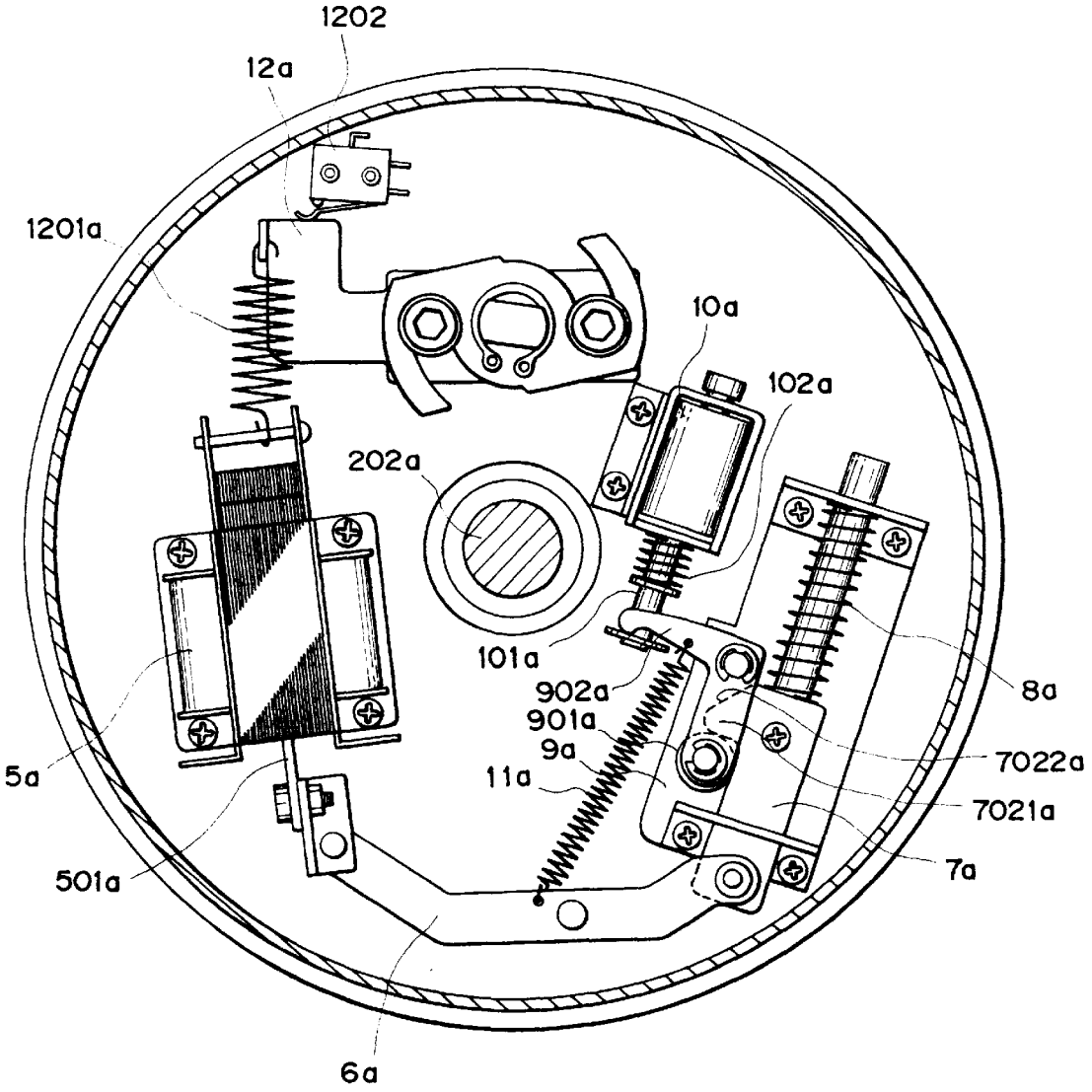
FIG. 4 is a sectional view of a second embodiment of the present invention shown in the braking status.

FIG. 4 shows a second embodiment of the present invention, using the same control circuit as illustrated in FIG. 5. In FIG. 4, an AC solenoid 5*a* is provided, wherein the lower end of the sliding rod 501*a* is connected to one end of the connecting rod and its upper end is connected to the brake rod 12*a* of the braking device by means of a spring 1201*a*. The other end of connecting rod 6*a* is connected to the lower end of the actuation rod 7*a*, and actuation rod 7*a* always tends to move downward because of the biasing action of spring 8*a*. A protrusion 7021*a* is formed to the left side of actuation rod 7*a* and a slanting surface 7022*a* is formed on the upper end of actuation rod 7*a*. A roller 901*a* is pivoted at the lower end of a latch rod 9*a* which is also pivoted to the left side of actuation rod 7*a* so that roller 901*a* fits into protrusion 7021*a* in the status as illustrated in FIG. 4 to stop actuation rod 7*a* from moving downward, thus maintaining the rotor in braking status. Furthermore, a lateral arm 902*a* extending from the upper part and toward the left of latch rod 9*a* penetrates into the shoulder at the front end of a sliding lever 101*a* of DC solenoid 10*a,* while a spring 11*a* acts upon lateral arm 902*a* to maintain the status when roller 901*a* fits into protrusion 7021*a*.

When power is being supplied, the way to block actuation rod 7*a* and release the braking device in the second embodiment is the same as that for the first embodiment. When button 19' is pressed, motor shaft 202*a* starts to turn, AC solenoid 5*a* is inoperative because no power is supplied and DC flows into DC solenoid 10*a*. Sliding rod 101*a* moves upward by overcoming the force from spring 102*a* to disengage said roller 901*a* from protrusion 7021*a*, thus releasing actuation rod 7*a* which slides downward due to the biasing action of precompressed spring 8*a* while causing connecting rod 6*a* to turn clockwise. Then the power supplied to relay 10*a* is cut off by the activation of microswitch 1202 which is activated by the action of spring 1201*a* on brake rod 12*a* which contacts microswitch 1202, so as to maintain the braking device in the released status, while motor 2 turns the rotor to wind up and open the door. Once the microswitch 24' is contacted by the rising door, power to motor 2 is cut off, actuation rod 7*a* is lifted up by the force of spring 8*a* when said AC solenoid 5 is activated by retaining relay 22, kept excited by capacitor 23. Roller 901*a* then enters into protrusion 7021*a* of actuation rod 7*a* to stop actuation rod 7*a* from moving downward, and the action from spring 1201*a* upon brake rod 12*a* brakes the rotor which is prevented from turning and prevents the door from falling.

In the event a fire starts and the power is cut off, capacitor 27 discharges to door closing delayed relay 28 to maintain contact 2801, which is already open because of the power supplied to it, in its open status. After a preset time of discharge by capacitor 27, contact 2801 is restored to its normally closed status while capacitor 29 starts to discharge to DC solenoid 10, which releases actuation rod 7*a* from latch rod 9*a*, thus loosening the pulling force of brake rod 12*a* and thereby release the brake of the braking device. Finally, the door is automatically unwound and closed.

What is claimed is;:

1. A rolling fire door with delayed closing mechanism arranged on a casing of a motor for driving a rotor of the rolling door, said delayed closing mechanism comprising:

an AC solenoid having a sliding rod with an operating end;

a connecting rod pivotally mounted on said motor casing having a first end pivotally connected to the operating end of said AC solenoid sliding rod;

a brake rod of a braking device which is spring biased for braking of said rotor;

a linearly guided brake actuation rod having a first end pivotally connected to a second end of said connecting rod and a second end facing said brake rod, said actuation rod being spring biased toward said brake rod, said actuation rod having a recess formed on a side thereof;

a latch rod pivotally mounted on said motor casing and having a roller pivotally mounted on a first end thereof, said latch rod being spring biased so that said roller thereof engages the recess formed on the side of said actuation rod;

a DC solenoid having a sliding rod for acting on a second end of said latch rod so that when said DC solenoid is electrically energized the sliding rod causes said latch rod to pivot against the spring bias acting thereon to disengage said latch rod roller from the recess formed on the side of said actuation rod; and control circuit means controlling said AC solenoid to cut off power thereto when said motor commences turning, electrically energizing said DC solenoid so that said latch rod roller disengages from the recess of said actuation rod permitting the spring bias acting thereon to move said actuation rod against said brake rod to release the braking of said rotor, simultaneously with the release of the braking of said rotor power to said DC solenoid is cut, and said AC solenoid is electrically energized when the rolling door is fully opened or fully closed causing the sliding rod thereof to retract to pivot said connecting rod and causing said actuation rod to move against its spring bias so that the latch rod roller engages the recess of said actuation rod to prevent movement thereof, then the power to said AC solenoid is cut.

2. The rolling fire door with delayed closing mechanism as defined in claim 1, wherein the control circuit means includes in parallel a motor control circuit, an AC solenoid circuit, a transformer and a rectifier, wherein the transformer secondary is further connected in parallel to a door opening circuit, a door closing circuit and a fire door closing circuit, said door opening circuit comprises a door opening button for activating said door opening circuit, a normally closed contact connected in series to a door closing relay, and a normally closed microswitch located at the fully open position of said door;

said door closing circuit comprises a door closing button for activating said door closing circuit, a normally closed contact connected in series to a door opening relay, and a normally closed microswitch located at the position where said door is fully closed;

said fire door closing circuit comprises in parallel a door closing delayed relay circuit, a capacitor circuit and a DC solenoid circuit, said circuits being connected to said rectifier, said door closing delayed relay circuit comprises a diode connected to a door closing delayed relay and a capacitor in parallel, said capacitor circuit comprises a diode and capacitor connected in series, said DC solenoid circuit comprises a DC solenoid and discharge circuit connected in parallel connected to a door opening relay normally open contact, a door closing relay normally open contact, and a fire relay normally open contact connected in parallel;

wherein said discharge circuit comprises a diode connected to a capacitor and a retaining relay connected in parallel, said DC solenoid connected in series to a normally open contact of said retaining relay, a constantly open contact of a microswitch located above said brake rod, and a given point between said capacitor in said capacitor circuit and said diode both connected to a normally closed contact of said door closing delay relay;

said AC solenoid circuit comprises an AC solenoid, a retaining relay normally open contact, fire relay normally closed contact, door closed relay normally closed contact, and door opening relay normally closed contact connected in series.

3. The rolling fire door with delayed closing mechanism as defined in claim 1, wherein said recess is formed between an upper protrusion and a lower protrusion on said brake actuation rod, and a slanting surface is formed on a lower side of said lower protrusion.

4. The rolling fire door with delayed closing mechanism as defined in claim 2, wherein the discharge time of said capacitor connected in parallel with said door closing delayed relay is adjustable.

5. A rolling fire door with delayed closing mechanism arranged on a casing of a motor for driving a rotor of the rolling door, said delayed closing mechanism comprising:

an AC solenoid having a sliding rod with a first end and an opposing second end;

a connecting rod pivotally mounted on said motor casing having a first end pivotally connected to the second end of said AC solenoid sliding rod;

a brake rod of a braking device for controlling the braking of said rotor, said brake rod being connected to the first end of said AC solenoid sliding rod;

a linearly guided brake actuation rod having a first end pivotally connected to a second end of said connecting rod, said actuation rod being spring biased toward said connecting rod, said actuation rod having a protrusion formed on a side thereof proximate said first end, said protrusion having a slanting surface formed on a surface thereof facing away from the first end of said actuation rod;

a latch rod pivotally mounted on said motor casing and having a roller pivotally mounted on a first end thereof, said latch rod being spring biased so that said roller thereof engages said protrusion on said actuation rod to prevent movement thereof toward said connecting rod, said latch rod further having a lateral arm at a second end thereof;

a DC solenoid having a sliding rod engaged with said latch rod lateral arm so that when said DC solenoid is electrically energized the sliding rod causes said latch rod to pivot against the spring bias acting thereon to disengage said latch rod roller from the protrusion formed on the side of said actuation rod; and control circuit means controlling said AC solenoid to cut off power thereto when said motor commences turning, electrically energizing said DC solenoid so that said latch rod roller disengages from the protrusion of said actuation rod permitting the spring bias acting thereon to move said actuation rod toward said connecting rod to cause said connecting rod to pivot to thereby move said AC solenoid sliding rod against said brake rod to release the braking of said rotor, simultaneously with the release of the braking of said rotor power to said DC solenoid is cut, and said AC solenoid is electrically energized when the rolling door is fully opened or fully closed causing the sliding rod thereof to move so as to pivot said connecting rod and causing said actuation rod to move against its spring bias so that the latch rod roller engages the protrusion on said actuation rod to prevent movement thereof, then the power to said AC solenoid is cut.

6. The rolling fire door with delayed closing mechanism as defined in claim 5, wherein the control circuit means includes in parallel a motor control circuit, an AC solenoid circuit, a transformer and a rectifier, wherein the transformer secondary is further connected in parallel to a door opening circuit, a door closing circuit and a fire door closing circuit, said door opening circuit comprises a door opening button for activating said door opening circuit, a normally closed contact connected in series to a door closing relay, and a normally closed microswitch located at the fully open position of said door;

said door closing circuit comprises a door closing button for activating said door closing circuit, a normally closed contact connected in series to a door opening relay, and a normally closed microswitch located at the position where said door is fully closed;

said fire door closing circuit comprises in parallel a door closing delayed relay circuit, a capacitor circuit and a DC solenoid circuit, said circuits being connected to said rectifier, said door closing delayed relay circuit comprises a diode connected to a door closing delayed relay and a capacitor in parallel, said capacitor circuit comprises a diode and capacitor connected in series, said DC solenoid circuit comprises a DC solenoid and discharge circuit connected in parallel connected to a door opening relay normally open contact, a door closing relay normally open contact, and a fire relay normally open contact connected in parallel;

wherein said discharge circuit comprises a diode connected to a capacitor and a retaining relay connected in parallel, said DC solenoid connected in series to a normally open contact of said retaining relay, a normally open contact of a microswitch located above said brake rod, and a given point between said capacitor in said capacitor circuit and said diode both connected to a normally closed contact of said door closing delay relay;

said AC solenoid circuit comprises an AC solenoid, a retaining relay normally open contact, fire relay normally closed contact, door closed relay normally closed contact, and door opening relay normally closed contact connected in series.

7. The rolling fire door with delayed closing mechanism as defined in claim 6, wherein the discharge time of said capacitor connected in parallel with said door closing delayed relay is adjustable.

* * * * *